US008220424B2

(12) United States Patent
Mischker et al.

(10) Patent No.: US 8,220,424 B2
(45) Date of Patent: Jul. 17, 2012

(54) ERROR CORRECTION DURING THE OPERATION OF ELECTROHYDRAULIC VALVE CONTROL SYSTEMS

(75) Inventors: Karsten Mischker, Leonberg (DE); Thomas Rommel, Stuttgart (DE); Hermann Gaessler, Vaihingen (DE); Milos Medvecky, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 523 days.

(21) Appl. No.: 12/202,830

(22) Filed: Sep. 2, 2008

(65) Prior Publication Data

US 2009/0064949 A1 Mar. 12, 2009

(30) Foreign Application Priority Data

Sep. 11, 2007 (DE) ..... 10 2007 043 250

(51) Int. Cl.
*F01L 9/02* (2006.01)

(52) U.S. Cl. ..... 123/90.12; 123/90.16

(58) Field of Classification Search ..... 123/90.12, 123/90.15, 90.16, 90.17
See application file for complete search history.

(56) References Cited

U.S. PATENT DOCUMENTS 6,092,495 A * 7/2000 Hackett ..... 123/90.15
2002/0166524 A1* 11/2002 Nakamura et al. ..... 123/90.16

* cited by examiner

*Primary Examiner* — Zelalem Eshete
(74) *Attorney, Agent, or Firm* — Merchant & Gould P.C.

(57) ABSTRACT

In a method for operating an electrohydraulic valve control system of an internal combustion engine, the electrohydraulic valve control system comprising at least one gas exchange valve actuator and a gas exchange valve, which is hydraulically actuated by it, an actuation characteristic is acquired during the operation of the internal combustion engine while the gas exchange valve is being actuated and is compared with a reference actuation characteristic, which describes a nominal characteristic of the gas exchange valve actuator.

7 Claims, 2 Drawing Sheets

ERROR CORRECTION DURING THE OPERATION OF ELECTROHYDRAULIC VALVE CONTROL SYSTEMS

TECHNICAL FIELD

The invention at hand relates to a method for operating an electrohydraulic valve control system of an internal combustion engine, wherein the electrohydraulic valve control system comprises at least one gas exchange valve actuator and one gas exchange valve, which is hydraulically actuated by it.

BACKGROUND

In internal combustion engines with electrohydraulic valve control systems (EHVS), the gas exchange valves of the internal combustion engine are actuated by electrohydraulic gas exchange valve actuators, so-called EHVS-actuators. These individually actuate the gas exchange valves, which are respectively associated with them, in order to open and close them according to the operating point.

EHVS actuators can be affected by different influences in their function for opening and closing associated gas exchange valves. This can unfavorably affect the normal engine performance and thereby the exhaust emission characteristics. In the event that during the operation of the internal combustion engine, a corresponding gas exchange valve is as a result not closed on time or completely, this can cause a collision with an adjacent gas exchange valve and/or with the piston of a corresponding combustion chamber. This can lead to a breakdown of the internal combustion engine, which is costly to repair.

The task of the invention at hand is thus to provide a method and a device, which make a detection and correction of errors possible during the operation of an internal combustion engine with an EHVS.

SUMMARY

This problem is solved by a method for operating an EHVS of an internal combustion engine. The EHVS comprises at least one gas exchange valve actuator and one gas exchange valve, which is hydraulically actuated by it. During the operation of the internal combustion engine, an actuation characteristic of the gas exchange valve actuator is acquired during actuation of the gas exchange valve. The acquired actuation characteristic is compared with a reference actuation characteristic. This describes a nominal characteristic of the gas exchange valve actuator.

The invention thereby makes a detection of errors possible, which can occur during the operation of the EHVS and which become noticeable by deviations of the acquired actuation characteristic from the reference actuation characteristic.

According to the invention, the actuation characteristic of the gas exchange valve actuator is continuously acquired during the operation of the internal combustion engine and is constantly compared with the reference actuation characteristic. When deviations occur between the acquired actuation characteristic and the reference actuation characteristic, an evaluation of the deviations takes place in order to determine whether another operation of the gas exchange valve actuator can lead to a breakdown of the internal combustion engine. In the event that a further operation of the gas exchange valve actuator cannot lead to a breakdown of the internal combustion engine, an adaptation of the activation parameters for the gas exchange valve actuator can take place in order to influence its actuation characteristic and to reduce the deviations.

The invention thus allows for a reaction even to small changes in the actuation characteristic of the gas exchange valve actuator and for an optimization of the performance of the internal combustion engine by appropriate steps.

In the event that another operation of the gas exchange valve actuator can lead to a breakdown of the internal combustion engine, the gas exchange valve actuator is switched off. In this way, the actuation characteristic of at least one other gas exchange valve actuator can be influenced in order to bring about a compensation for the performance of the internal combustion engine, which has been changed as a result of switching off the gas exchange valve actuator.

More extensive damage to the internal combustion engine, which can lead to costly repairs, is thus avoided; and at the same time, the further operational availability of the internal combustion engine is assured in order, for example, to enable the driver to reach home or the repair shop.

According to the invention, the actuation characteristic of the gas exchange valve actuator is determined through acquisition of the movement of the gas exchange valve by at least one valve lift sensor. The actuation characteristic of the gas exchange valve actuator is alternatively determined by an evaluation of at least one state variable of the internal combustion engine. This includes at least one of the following variables: combustion chamber pressure, crankshaft rotational speed, gradient of the crankshaft rotational speed, structure-borne noise, oil pressure, air mass and pressure in the air intake and exhaust gas systems.

The invention can thus be cost effectively implemented in a simple manner.

The problem mentioned at the beginning of the application is also solved by an electrohydraulic valve control system for an internal combustion engine, which comprises at least one gas exchange valve actuator and one gas exchange valve, which is hydraulically actuated by it. The electrohydraulic valve control system is configured in such a way, that during the operation of the internal combustion engine, an actuation characteristic of the gas exchange valve actuator is acquired while the gas exchange valve is being actuated; and that said actuation characteristic is compared with a reference actuation characteristic, which describes a nominal characteristic of the gas exchange valve actuator.

BRIEF DESCRIPTION OF THE DRAWINGS

An example of embodiment of the invention at hand is explained below in detail using the attached drawings. The following are shown.

DETAILED DESCRIPTION

Figure 1:
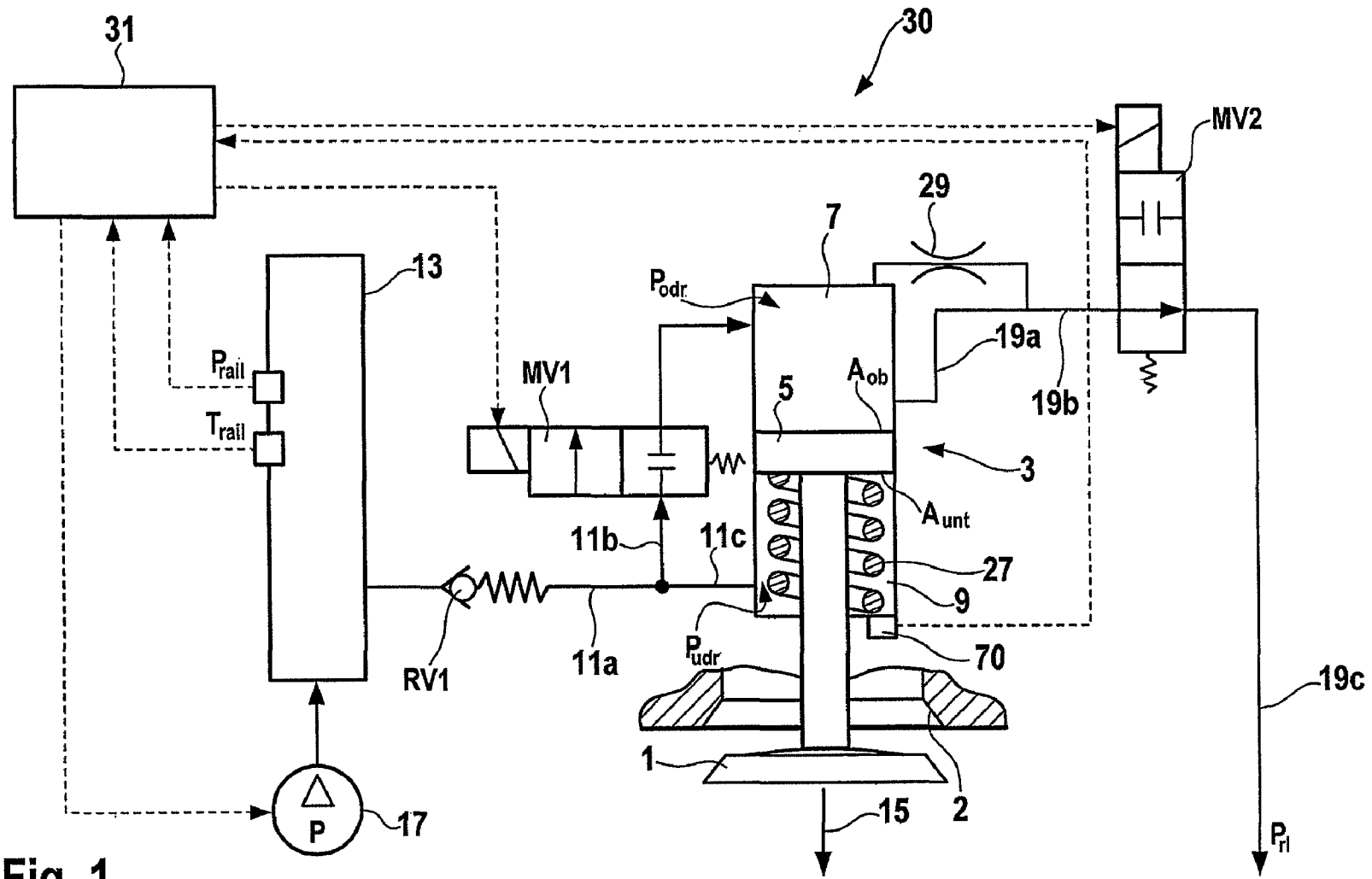
FIG. 1 is a schematic depiction of an electrohydraulic gas exchange valve actuator.

FIG. 1 shows a schematic depiction of an EHVS actuator 30 with an hydraulic work cylinder 3, which in the example depicted serves to actuate an hydraulically actuable gas exchange valve 1 of an internal combustion engine, for example a combustion engine or a compressor. The gas exchange valve 1 can be implemented as an intake valve EV as well as an exhaust valve AV. If the gas exchange valve 1 is closed, it lies on a valve seat 2.

The EHVS actuator 30 furthermore comprises an electrically activated, high-pressure-side control valve MV1, which subsequently is also denoted as the first control valve MV1, and an electrically activated low-pressure-side control valve MV2, which subsequently is also denoted as the second control valve MV2, as well as the hydraulic lines 11, 19*a* and 19*b*, a valve brake 29 and an optional check valve RV1. The stated components are integrated in a single structural unit in typical embodiments of the EHVS actuator 30. When describing the actuating operations of the EHVS actuator 30, the mass of a gas exchange valve 1 connected to the piston 5 as well as the friction ratios in a guide of the valve shaft (not depicted) is included.

The work cylinder 3 represents the central, mechanical-hydraulic component of the EHVS actuator 30 and is configured as a differential cylinder with a piston 5 with a piston rod at one end. The work cylinder 3 can, however, also be implemented with a double-end piston rod (not depicted), which extends from both sides of the piston.

The piston 5 has a larger upper effective surface $A_{ob}$ and a smaller lower effective surface $A_{unt}$. The upper effective surface $A_{ob}$ limits a first work chamber 7 of the work cylinder 3. The lower effective surface $A_{unt}$ limits a second work chamber 9. Both work chambers 7, 9 are provided with pressurized hydraulic fluid, as for example hydraulic oil, by a supply line 11, which consists of the sections 11*a*, 11*b* and 11*c*. For this purpose, the work cylinder 3 is hydraulically connected in the high pressure region via the supply line 11 and the first check valve RV1, which is installed therein, to a high pressure accumulator 13, which provides the hydraulic energy for the actuating operation.

The first control valve MV1 is disposed in a section 11*b* of the supply line 11. Said section connects the second work chamber 9 and the first work chamber 7. In the switching state depicted in FIG. 1, this first control valve MV1 is closed and without current.

The hydraulic fluid in the first work chamber 7 can be carried off via a depressurized return line 19 or one pressurized with a low static pressure, which consists of the sections 19*a*, 19*b* and 19*c*. The second control valve MV2, which is depicted in FIG. 1 as being open, is disposed in the return line 19. The second control valve MV2 can, for example, be opened without current.

Provision can be made in the second work chamber 9 for a closing spring 27, which brings the gas exchange valve 1 into the closing position, i.e. in contact with the valve seat, respectively holds in this position, when the work cylinder 3 is depressurized. In an alternative embodiment (not shown in FIG. 1), the closing spring 27 can also be configured in such a way, that it alone generates the closing force and takes on a correspondingly large amount of potential energy during the opening operation. In this case, the hydraulic connection 11*c* and the function of the second work chamber 9, i.e. the impingement of the lower effective surface $A_{unt}$ of the piston 5 with the pressure of the high pressure accumulator 13, are omitted. The hydraulic work cylinder 3 is then configured in this case as a simply acting work cylinder. In another modification of this embodiment, the spring is progressively configured, i.e. with a spring tension, which increases over the regulating distance of the piston 5.

It is likewise possible to combine the previously described hydraulic and mechanical force generation in order to provide the closing force of the hydraulic actuator. Furthermore, it is possible to configure the piston 5 in such a way that the effective surface $A_{ob}$ changes over the travel of the piston 5 by at least one gradation, particularly becomes smaller. For example, the piston 5 can be implemented as a two-stage, stepped piston (unspecified); and in so doing, a first stage of the piston, which only travels along a first partial length during opening of the gas exchange valve 1, provides an additional effective surface for the pressure in the first work chamber 7. In this embodiment of the EHVS actuator 30, the upper effective surface $A_{ob}$ and consequently the opening force of the EHVS actuator 30 are then increased during the duration of a first partial length of piston travel when the gas exchange valve 1 is opened. This has the advantage that the gas exchange valve 1 can be opened against higher gas forces and also faster.

Additional embodiments of the work cylinder 3, respectively of the EHVS actuator, which are not mentioned in detail here, are possible and are suited in a similar manner for the application of the control method according to the invention.

The high pressure accumulator 13 is provided with the hydraulic fluid, which is under high pressure, by the high pressure pump 17. Provision is made for the check valve RV1 in the section 11*a* of the supply line, which connects the high pressure accumulator 13 to the second work chamber 9. Said check valve RV1 prevents a backflow of hydraulic fluid from the second work chamber 9 into the high pressure accumulator 13.

Provision is made for the hydraulic brake mechanism 29 to be between the first work chamber 7 and the second control valve MV2. This works as follows: when the piston 5 moves upwards and as a result the volume of the first work chamber 7 is reduced, the hydraulic fluid flows out of the first work chamber 7 through the section 19*a* of the return line 19 as long as the piston 5 closes off the section 19*a* of the return line 19. After this, the hydraulic fluid can only flow out of the first work chamber 7 via the hydraulic brake mechanism 29, which essentially consists of a flow control valve, because the connection to the hydraulic brake mechanism 34 is disposed as depicted at the upper end of the work chamber 7. By means of the increased flow resistance of the hydraulic brake mechanism 29 in comparison to the flow resistance of the section 19*a* of the return line, the piston is slowed down prior to the gas exchange valve 1 being seated on the valve seat 2.

Temperature sensors $T_{rail}$ and pressure sensors $P_{rail}$, which are connected to a control unit 31 via signal lines, are disposed in the high pressure accumulator 13. The high pressure pump 17, the first control valve MV1 and the second control valve MV2 are likewise connected to the control unit 31 via signal lines and are activated by said control unit 31. The signal lines are depicted as dashed lines in FIG. 1.

The hydraulic brake mechanism 29 can, as indicated by a signal line in FIG. 1, be configured as an active brake mechanism and can be activated as required via the signal line by the control unit 31. The pressure $P_{rail}$ of the high pressure accumulator 13 can also be controlled in a closed-loop as a function of the desired actuation or opening force of the gas exchange valve 1 using a corresponding activation of the high pressure pump 17.

If, as is depicted in FIG. 1, the first control valve MV1 is closed and the second control valve MV2 is open, the pressure $p_{udr}$ in the second work chamber 9 causes the gas exchange valve 1 to move against the direction of the arrow 15 and thereby to close. The force required for this action is thus provided, in that the second work chamber 9 is supplied with the hydraulic fluid, which is under high pressure, by the supply line 11, while the pressure $p_{odr}$ in the first work chamber 7 quickly drops due to the hydraulic connection to the return line 19 and finally equals the very low pressure $p_{R1}$ in the section 19*c* of the return line.

In order to open the gas exchange valve, the second control valve MV2 is closed and subsequently the first control valve MV1 is opened. In so doing, an equalization of pressure takes place between the first work chamber 7 and the second work chamber 9.

As a result of this, the gas exchange valve 1 opens, because the front surface $A_{ob}$ of the piston 5, which is impinged upon with pressure from the first work chamber 7, is larger than the ring surface $A_{unt}$ of the piston, which is impinged upon with pressure from the second work chamber 9.

The activation of the first control valve MV1 is of great importance for the following two reasons: for the control of the opening of the gas exchange valve 1 and specifically for the valve lift resulting from this action. First of all the beginning of the opening movement of the gas exchange valve 1 is established with the opening of the first control valve MV1; and secondly the duration of the activation—subsequently denoted as activation duration $t_{m1}$—has a significant influence on the lift of the gas exchange valve 1. The activation duration $t_{m1}$ establishes how long the first control valve MV1 stays opened; and the quantity of the hydraulic fluid flowing from the high pressure accumulator 13 into the first work chamber 7 results from the length of time said control valve MV1 stays opened, which in turn directly determines the valve lift. Therefore, by the first control valve MV1 being closed again at the correct point in time, the desired valve lift of the gas exchange valve 1 is achieved. This can be measured by a suitable lift sensor 70, which is connected to the control unit 31 via a signal line. In other words, the regulating distance or the lift of the EHVS actuator 30, respectively the piston 5, can be determined with the lift sensor 70.

When the gas exchange valve 1 is supposed to be closed again, the second control valve MV2 is opened, so that the pressure $p_{odr}$ in the first work chamber 7 breaks down, and the hydraulic force exerted on the piston 5 from the second work chamber 9 closes the gas exchange valve 1.

The control method according to the invention, which is subsequently described, is not limited to the system implementation, which was previously described on the basis of an example. Piezoelectric valves can also, for example, be used instead of magnetic switch-over valves and/or proportional valves instead of switch-over valves. Multiway valves are also possible instead of 2/2 way valves. It is also, for example, possible to implement the first control valve MV1 and the second control valve MV2 as functional parts of a single control valve; and in so doing, this control valve can adjust to more than two positions.

In another possible embodiment, the first control valve MV1, or also a combined control valve (MV1, MV2), can also be actuated by means of hydraulic compressive force, whereby additional control valves, for example electrohydraulic servo valves, are employed. In this case, the method according to the invention for the lift control is thereby used to determine the activation of a servo valve, which serves to close the control valve MV1 and thereby to meter the hydraulic fluid, which is flowing during the actuation process, in such a way that a desired displacement of the piston 5, respectively a desired lift of the gas exchange valve 1, is brought about.

The pressure supply can also be fixed instead of variable. The check valve RV1 can also be omitted. Additional components, which are not shown here, can also be present in the hydraulic switching circuit. For example, there could be a connection of the first work chamber 7 of the work cylinder 3 with the high pressure accumulator 13 via an additional check valve.

The scope of the sensors can be reduced or expanded with regard to the example depicted in FIG. 1. There can be, for example, a plurality of pressure sensors, which preferably are distributed at different points in the high pressure accumulator 13 but can also be positioned directly at the outset of the individual work cylinders 3. Provision can also be made for an acquisition of the oil temperature—alternatively or in addition to the location indicated in FIG. 1—at the input on the high pressure side or in the work chambers 7 and 9 of the individual work cylinders 3.

Moreover, provision can be made for additional sensors for the temperature of structural material, as, for example, cylinder heads, work cylinder housings, actuator housings or magnetic valve housings, or ones for the coil temperature of magnetic valves and/or for a sensor for acquiring the oil viscosity. Provision can particularly be made for suitable sensors, which allow for an acquisition of state variables of the internal combustion engine, as, for example, combustion chamber pressure, structure-borne noise and/or oil pressure. Pertinent information obtained by the sensors can be included in the control method according to the invention for the improvement of the control system accuracy in the lift control and for the error correction.

In typical and advantageous embodiments of an EHVS actuator 30, its components depicted in FIG. 1 are integrated into one individual, structural unit. In enhanced embodiments, this integrated unit can also comprise additional sensors and/or respective parts of the control system electronics, which are represented in FIG. 1 by the control unit 31. The control unit can, for example, implement, respectively integrate, an error memory for the storage of errors, which can occur during the operation of the EHVS actuator 30.

The control unit 31 can, therefore, particularly consist of a plurality of separate parts, respectively electronic modules (unspecified), which are connected with each other via electrical lines, respectively communication channels and which—completely or partially—can be attached to individual EHVS actuators or mounted on these actuators.

The method for controlling an actuation of the hydraulic work cylinder 3, respectively the EHVS actuator 30, which is explained using the example of embodiment in FIG. 1, is applicable by direct transfer to all of the system configurations, which are mentioned here, as well as to additional configurations, which are derived by way of generalization. Said method is especially independent of the intended use of the hydraulic work cylinder 3. Moreover, the EHVS actuator 30, as introductorily stated, is also not limited to the intended use of the work cylinder 3 in this example.

Figure 2:
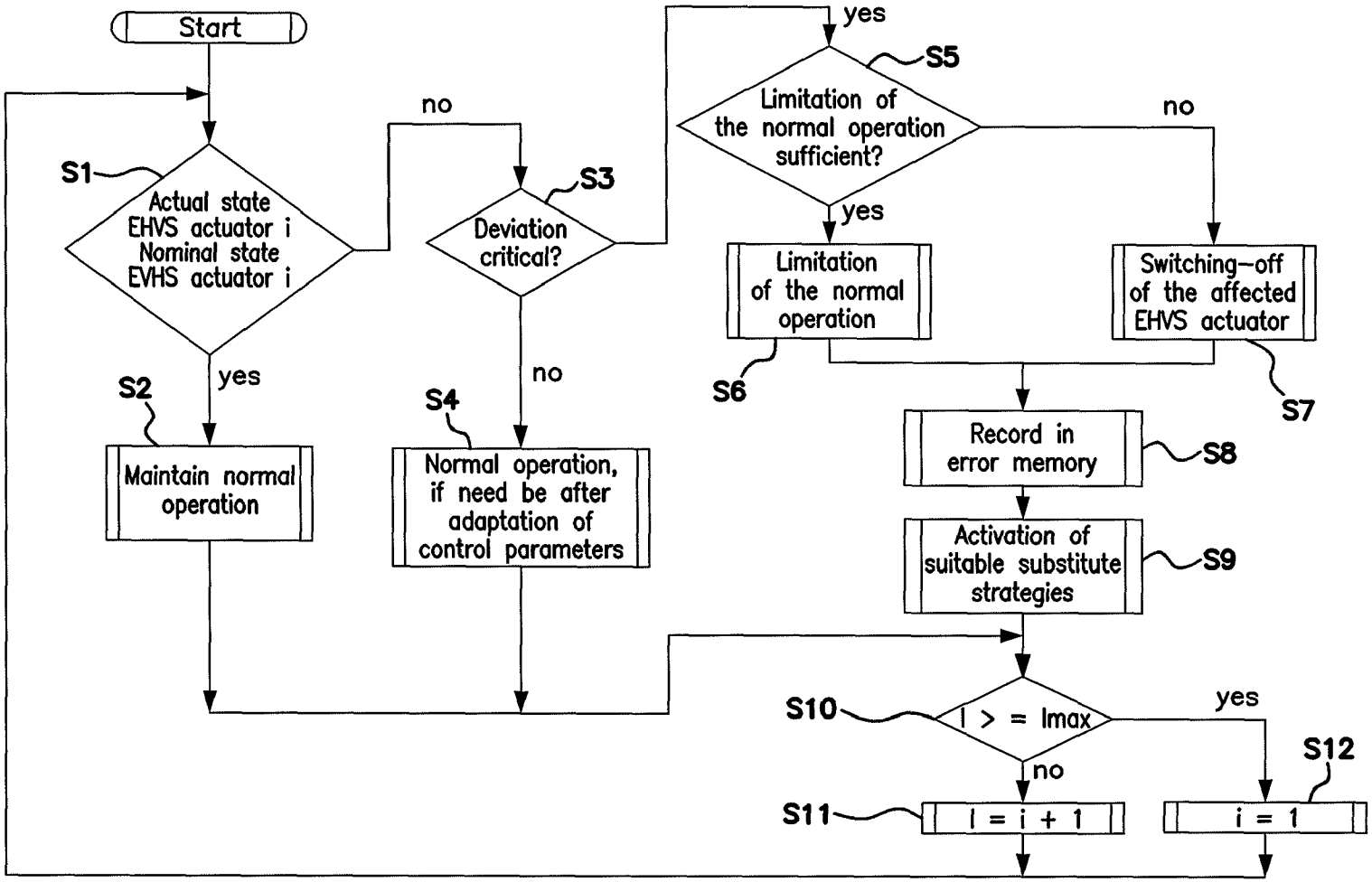
FIG. 2 is a flow diagram of a method for operating an internal combustion engine with EHVS.

FIG. 2 shows a flow diagram of a control method for operating an internal combustion engine with EHVS. This EHVS has at least one EHVS actuator (for example the gas exchange valve actuator 30 in FIG. 1) for actuating one of these hydraulically actuable gas exchange valves (for example: gas exchange valve 1 in FIG. 1). According to the invention, the control method is continuously implemented during the operation of the internal combustion engine.

The control method depicted begins with step S1, whereat an actuation characteristic of the EHVS actuator, which is denoted here as EHVS actuator i, is acquired and compared with a reference actuation characteristic. The acquired actuation characteristic of the EHVS actuator describes its actual state, which can be directly determined from an acquisition of the gas exchange valve movement with one or a plurality of lift sensors (for example: lift sensor 70 in FIG. 1). As an alternative to this, the actual state can be indirectly determined via an evaluation of one or a plurality of state variables of the internal combustion engine, for example by evaluation of the combustion chamber pressure, crankshaft rotational speed, gradient of the crankshaft rotational speed, air mass, pressure in the air intake or exhaust gas system, structure-borne noise and/or oil pressure.

The reference actuation characteristic of the EHVS actuator i describes its nominal characteristic, respectively a nominal state of the EHVS actuator i. Said nominal state can describe a generalized, idealized actuation characteristic of EHVS actuators, which, for example, is determined in a development phase of EHVS actuators of the same type and is deposited in an associated control unit (for example: control unit 31 in FIG. 1) for the operation of the EHVS actuator i. The nominal characteristic can particularly describe an essentially error-free actuation characteristic of the EHVS actuator i, which characterizes its normal operation. As an alternative to this, the reference actuation characteristic can also be uniquely ascertained during defined operating conditions for the EHVS actuator i and deposited in the associated control unit. This makes the storage of an individually determined reference actuation characteristic possible for every EHVS actuator of the internal combustion engine.

In the event it is determined in step S1 that the actual state and the nominal state of the EHVS actuator i correlate with each other, the internal combustion engine is further operated in the normal operation mode in step S2, i.e. without any manipulation by the EHVS. The control method is continued after step S2 at step S10 as described below.

In the event it is determined in step Si that the actual state of the EHVS actuator i deviates from the nominal state, an evaluation of the deviations, which have occurred, takes place in step S3 in order to determine whether a further operation of the EHVS actuator i can lead to a breakdown of the internal combustion engine. In the event a further operation of the EHVS actuator i can lead to a breakdown of the internal combustion engine, the deviations, which have occurred, are regarded as critical.

Critical deviations are, for example, deviations due to errors in the actuation characteristic of the EHVS actuator i, which especially can prevent a timely or less than complete closing of the associated gas exchange valve. This can result in a collision with an adjacent gas exchange valve and/or with the piston of a corresponding combustion chamber, which can lead to a breakdown of the internal combustion engine and require a costly repair.

In the event the deviations, which are occurring, are not regarded as critical in step S3, i.e. a further operation of the EHVS actuator i can not lead to a breakdown of the internal combustion engine, the internal combustion engine is further operated in the normal operation mode, i.e. without any manipulation by the EHVS. The control method is continued after step S4 at step S10 as is described below. As an alternative to this, an adaptation of the activation parameters for the EHVS actuator can occur in step S4 in order to influence its actuation characteristic in such a way that a matching of the actual state and the nominal state occurs and the deviations, which have occurred, are thereby compensated or at least reduced.

In the event the deviations, which are occurring, are regarded as critical in step S3, this means that errors are occurring in the operation of the EHVS actuator i. A check is therefore made in step S5 to determine whether a limitation of the normal operation mode by changing the activation parameters of the EHVS actuator i is sufficient for correcting the errors in order to avoid a breakdown of the internal combustion engine. If this is the case, an appropriate limitation of the normal operation mode occurs in step S6 prior to the control method proceeding as described below in step S8. In the event, however, in step S5, it is determined that a limitation of the normal operation mode of the internal combustion engine is not sufficient to prevent its possible breakdown, the EHVS actuator i is switched off in step S7 prior to the control method proceeding as described below in step S8.

In step S8, the errors, which have occurred, are recorded in an appropriate error memory (for example: control unit 31 of FIG. 1) for diagnostic and repair purposes of a repair shop.

In step S9, the activation of suitable substitute strategies for achieving an optimized further system performance of the internal combustion engine takes place. These, for example, serve to compensate the errors occurring at the EHVS actuator i in such a way that they can no longer be perceived by the user of the internal combustion engine from the system performance of the internal combustion engine or from a corresponding noise development; and in so doing, the further operational availability of the internal combustion engine is assured in order, for example, to enable the driver to reach home or a repair shop. The activation of suitable substitute strategies comprises, for example, the manipulation of the actuation characteristic of at least one other EHVS actuator of the internal combustion engine in such a way that a compensation for the performance of the internal combustion engine, which has changed as a result of the EHVS actuator being switched off, occurs.

In step S10, it is determined whether the control method has been implemented for all of the EHVS actuators of the internal combustion engine, i.e. if i>=imax. If this is not the case, the implementation of the method for a proximate EHVS actuator, i.e. EHVS actuator i+1 is introduced in step S11; and the process begins for this actuator at step S1 as previously described. Otherwise the control method is again introduced for the first EHVS actuator of the internal combustion engine, i.e. EHVS actuator i=1, in step S12 and implemented beginning at step S1. The control method according to the invention is accordingly implemented in the operation of the internal combustion engine in the shape of a loop, whereby the actuation characteristic of the EHVS actuator i is continuously acquired and is constantly compared with its reference actuation characteristic.

Multiple modifications of the control method can additionally improve the error correction in the operation of the EHVS actuators. For example, it can be helpful, respectively necessary, to evaluate specific operating states of the internal combustion engine, like the state, in which the internal combustion engine yields no torque (the so-called overrun mode), or during run-out of the internal combustion engine in the shutdown phase or when starting the engine. Furthermore, selected EHVS actuators can be switched off in internal combustion engines with a plurality of valves in order to be able to better identify errors, which are occurring. For example, in a four valve internal combustion engine, two gas exchange valves respectively on the intake and exhaust side and therewith respectively two EHVS actuators are simultaneously activated, of which one can be switched off at any one time. The actual state of the respective EHVS actuator, which remains active, can then be individually analyzed for error determination. At this point an explicit identification of a faulty EHVS actuator is possible by inverting the activation model.

The control method according to the invention can be implemented in the normal operation mode of the internal combustion engine as is described above. As an alternative to this, the control method for detecting errors can be respectively implemented in phases of the operation, in which no torque is yielded.

The invention claimed is:

1. A method of operating an electrohydraulic valve control system during an operation of an internal combustion engine, wherein the electrohydraulic valve system comprises at least one hydraulic work cylinder directly connected to a gas exchange valve, the method comprising:

hydraulically actuating the gas exchange valve with the at least one hydraulic work cylinder, wherein the gas exchange valve is directly actuated by the hydraulic work cylinder;

acquiring an actuation characteristic of the at least one hydraulic work cylinder, wherein the actuation characteristic is acquired during an actuation of the gas exchange valve;

comparing the acquired actuation characteristic with a reference actuation characteristic, wherein the reference actuation characteristic describes a nominal characteristic of the gas exchange valve actuator;

determining if a deviation occurs between the acquired actuation characteristic and the reference actuation characteristic;

evaluating the deviation to determine whether a further operation of the at least one hydraulic work cylinder can lead to a breakdown of the internal combustion engine; and switching off the at least one gas exchange valve actuator in the event a further operation of the gas exchange valve actuator can lead to a breakdown of the internal combustion engine, wherein an actuation characteristic of at least one other gas exchange valve actuator, different from the at least one gas exchange valve actuator, of the internal combustion engine is manipulated in order to effect a compensation for a changed performance of the internal combustion engine as a result of switching off the at least one gas exchange valve actuator.

2. A method according to claim 1, further comprising continuously acquiring the actuation characteristic of the at least one gas exchange valve actuator during the operation of the internal combustion engine, wherein the actuation characteristic is constantly compared with the reference actuation characteristic.

3. A method according to claim 1, further comprising implementing an adaptation of one or more activation parameters for the at least one gas exchange valve actuator, wherein the adaptation is implemented to manipulate the actuation characteristic of the at least one gas exchange valve actuator and reduce any further deviation in the event a further operation of the at least one gas exchange valve actuator cannot lead to a breakdown of the internal combustion engine.

4. A method according to claim 1, further comprising determining the actuation characteristic of the at least one gas exchange valve actuator by an acquisition of a movement of the gas exchange valve by at least one lift sensor.

5. A method according to claim 1, further comprising determining the actuation characteristic of the at least one gas exchange valve actuator by an evaluation of at least one state variable of the internal combustion engine.

6. A method according to claim 5, wherein the at least one state variable of the internal combustion engine comprises of one of:

a) a combustion chamber pressure;

b) a crankshaft rotational speed;

c) a gradient of a crankshaft rotational speed;

d) a structure-borne noise;

e) an oil pressure; or f) an air mass and a pressure in an air intake system or an exhaust gas system.

7. An electrohydraulic valve control system for an internal combustion engine comprising:

at least one hydraulic work cylinder directly connected to a gas exchange valve, wherein the gas exchange valve is directly hydraulically actuated by the least one hydraulic work cylinder;

wherein during an operation of the internal combustion engine the electrohydraulic valve control system is configured to:

acquire an actuation characteristic of the at least one hydraulic work cylinder during an actuation of the gas exchange valve;

compare the acquired actuation characteristic with a reference actuation characteristic that describes a nominal characteristic of the hydraulic work cylinder;

determine if a deviation occurs between the acquired actuation characteristic and the reference actuation characteristic;

evaluate the deviation to determine whether a further operation of the at least one hydraulic work cylinder can lead to a breakdown of the internal combustion engine; and switch off the at least one gas exchange valve actuator in the event a further operation of the gas exchange valve actuator can lead to a breakdown of the internal combustion engine, wherein an actuation characteristic of at least one other gas exchange valve actuator, different from the at least one gas exchange valve actuator, of the internal combustion engine is manipulated in order to effect a compensation for a changed performance of the internal combustion engine as a result of switching off the at least one gas exchange valve actuator.

* * * * *